US006958116B1

(12) United States Patent
Bennett

(10) Patent No.: US 6,958,116 B1
(45) **Date of Patent: *Oct. 25, 2005**

(54) CATHODIC PROTECTION SYSTEM

(76) Inventor: Jack E. Bennett, 10039 Hawthorne Dr., Chardon, OH (US) 44024

( * ) Notice: Subject to any disclaimer, the term of this patent is extended or adjusted under 35 U.S.C. 154(b) by 581 days.

This patent is subject to a terminal disclaimer.

(21) Appl. No.: 10/130,896

(22) PCT Filed: Nov. 27, 2000

(86) PCT No.: PCT/US00/32350

§ 371 (c)(1),
(2), (4) Date: May 23, 2002

(87) PCT Pub. No.: WO01/40547

PCT Pub. Date: Jun. 7, 2001

Related U.S. Application Data

(63) Continuation-in-part of application No. 09/451,173, filed on Nov. 30, 1999, now Pat. No. 6,217,742, which is a continuation-in-part of application No. 09/236,731, filed on Jan. 25, 1999, now Pat. No. 6,033,553, and a continuation-in-part of application No. 08/839,292, filed on Apr. 17, 1997, now Pat. No. 6,471,851, and a continuation-in-part of application No. 08/731,248, filed on Oct. 11, 1996, now abandoned.

(51) Int. Cl.[7] ..... C23F 13/00

(52) U.S. Cl. ..... 205/734; 204/196.36; 204/196.18; 204/196.19; 204/196.21

(58) Field of Search ..... 205/734; 204/196.36, 204/196.18, 196.19, 196.21

(56) References Cited

U.S. PATENT DOCUMENTS 6,217,742 B1 * 4/2001 Bennett ..... 205/734

* cited by examiner

*Primary Examiner*—Bruce F. Bell
(74) *Attorney, Agent, or Firm*—James A. Lucas; Driggs, Lucas, Brubaker & Hogg Co., LPA

(57) ABSTRACT

The present invention relates to a method of and an apparatus (20) for cathodic protection of reinforced concrete using discrete anodes (22) in or on the reinforced concrete member (14) to improve performance and service life of the discrete anodes. The discrete anode (22) is embedded in a cementitous grout or mortar (24) to encapsulate the anode (22) and provide contact to complete the cathodic protection circuit. A lithium salt is added to the cementitous grout or mortar (24) in an amount of at least about 0.05 gram per cubic centimeter. The lithium salt functions to enhance the performance of the cathodic protection system (20) by minimizing the deleterious effects of the anode reaction products on the grout or mortar adjacent to the anode and increasing the protective current delivered to the reinforcing steel.

31 Claims, 4 Drawing Sheets

CATHODIC PROTECTION SYSTEM

This application is a continuation-in-part of prior application Ser. No. 09/451,173 filed Nov. 30, 1999, now U.S. Pat. No. 6,217,742, which in turn was a continuation-in-part of parent application Ser. No. 09/236,731 filed Jan. 25, 1999, now U.S. Pat. No. 6,033,553, Ser. No. 08/731,248 filed Oct. 11, 1996 now abandoned and Ser. No. 08/839,292 filed Apr. 17, 1997 now U.S. Pat. No. 6,471,851.

BACKGROUND OF THE INVENTION

1. Technical Field

This invention relates generally to the field of cathodic protection systems for steel-reinforced concrete structures, and is particularly concerned with the performance of cathodic protection systems utilizing discrete anode elements embedded in cementitous grout or mortar.

2. Description of the Prior Art

The problems associated with corrosion-induced deterioration of reinforced concrete structures are now well understood. Steel reinforcement has generally performed well over the years in concrete structures such as bridges, buildings, parking structures, piers, and wharves, since the alkaline environment of concrete causes the surface of the steel to "passivate" such that it does not corrode. Unfortunately, since concrete is inherently somewhat porous, exposure to salt results in the concrete over a number of years becoming contaminated with chloride ions. Salt is commonly introduced to the concrete in the form of seawater, set accelerators or deicing salt.

When the chloride contamination reaches the level of the reinforcing steel, it destroys the ability of the concrete to keep the steel in a passive, or non-corrosive state. It has been determined that a chloride concentration of 0.6 Kg per cubic meter of concrete is a critical value above which corrosion of steel can occur. The products of corrosion of the steel occupy 2.5 to 4 times the volume of the original steel, and this expansion exerts a tremendous tensile force on the surrounding concrete. When this tensile force exceeds the tensile strength of the concrete, cracking and delaminations develop. With continued corrosion, freezing and thawing, and traffic pounding, the utility or the integrity of the structure is finally compromised and repair or replacement becomes necessary. Reinforced concrete structures continue to deteriorate at an alarming rate today. In a recent report to Congress, the Federal Highway Administration reported that of the nation's 577,000 bridges, 226,000 (39% of the total) were classified as deficient, and that 134,000 (23% of the total) were classified as structurally deficient. Structurally deficient bridges are those that are closed, restricted to light vehicles only, or that require immediate rehabilitation to remain open. The damage on most of these bridges is caused by corrosion of reinforcing steel. The United States Department of Transportation has estimated that $90.9 billion will be needed to replace or repair the damage on these existing bridges.

Many solutions to this problem have been proposed, including higher quality concrete, improved construction practices, increased concrete cover over the reinforcing steel, specialty concretes, corrosion inhibiting admixtures, surface sealers, and electrochemical techniques such as cathodic protection and chloride removal. Of these techniques, only cathodic protection is capable of controlling corrosion of reinforcing steel over an extended period of time without complete removal of the salt contaminated concrete.

Cathodic protection reduces or eliminates corrosion of the steel by making it the cathode of an electrochemical cell. This results in cathodic polarization of the steel, which tends to suppress oxidation reactions (such as corrosion) in favor of reduction reactions (such as oxygen reduction). Cathodic protection was first applied to a reinforced concrete bridge deck in 1973. Since then, understanding and techniques have improved, and today cathodic protection has been applied to over one million square meters of concrete structure worldwide. Anodes, in particular, have been the subject of much attention, and several types of anodes have evolved for specific circumstances and different types of structures.

One type of anode that has been utilized for cathodic protection of reinforced concrete structures is catalyzed titanium. The most common configuration of catalyzed titanium anode has been a highly expanded mesh of chemically pure titanium, which is catalyzed by a thin surface coating of precious metal or mixed metal oxides. The anode mesh strands are generally less than about 1⅓ inches (3 centimeters) apart. This type of anode has been especially successful for protection of reinforced concrete decks, in which case the anode is fastened to the top concrete surface and overlaid by typically 1–4 inches (2.5–10 centimeters) of fresh concrete. This is known as a distributed anode system since it essentially covers the entire surface of the structure being protected. The fresh concrete overlay serves both to encapsulate the anode and provide a new riding surface for the concrete deck. Approximately 10,000,000 square feet (100,000 square meters) of catalyzed titanium anode have been installed in this way, and such systems have generally provided a long and trouble-free service life.

Another form of catalyzed titanium anode that has been used extensively consists of a pure titanium ribbon, 0.5–0.75 inch (1.25–1.9 centimeters) wide by typically 250 ft (63 meters) long, which is also catalyzed by a thin surface coating of precious metal or mixed metal oxides. The titanium ribbon anode may be flat, or more commonly, it may be expanded to increase surface area and provide a better bond to the concrete. This type of ribbon mesh anode has typically been installed in slots 0.5 inch (1.25 centimeters) wide by 0.75 inch (1.9 centimeters) deep, cut into the top surface of a concrete deck. The slots are typically spaced 12 inches (30.5-centimeters) apart. This type of cathodic protection is therefore referred to as a "slotted" system. After the catalyzed titanium anode has been placed in the slot, the slot is backfilled with a cementitous grout or mortar to encapsulate the anode ribbon and provide a flat riding surface. This type of slotted system has been particularly advantageous for cathodic protection of reinforced concrete parking garage decks, since it can be installed without loss of headroom in the garage and without imposing additional dead weight on the structure.

However, these slotted systems have not been generally successful. After a period of use, the grout in the slots becomes stained by an acidic liquid, and the grout appears dark and wet. This acidic liquid attacks the cement paste and causes deterioration of the grout or mortar surrounding the anode. In extreme cases, this liquid has completely destroyed the grout, leaving the anode fully exposed. In other cases, the liquid has damaged and penetrated the concrete deck. Such attack has caused the voltage of the cathodic protection system to rise, and in time adequate protective current could not be supplied within the compliance voltage of the power supply. It has been speculated that such failures have occurred in non-distributed slotted systems because the cathodic protection current is confined to a relatively small area, thus concentrating the acidic anode reaction products to a small volume of concrete grout. This is in contrast to the more successful highly expanded mesh anode, which effectively distributes the current and the anodic reaction products over a much larger area.

The catalyzed titanium ribbon anode has also been used in another type of non-distributed system or discrete anodes. In this case, a hole, typically 0.75–1 inch (1.9–2.5 centimeters) in diameter and 6–24 inches (15.2–61 centimeters) long is drilled into the concrete member. The hole is filled with cementitous grout or mortar and the catalyzed titanium anode is inserted into the fresh grout or mortar. This system is claimed to be advantageous for larger concrete members such as columns and beams.

But these discrete anodes suffer the same problems as slotted systems. The acidic anode reaction products are confined to a relatively small area surrounding the anode, and eventually cause damage to the cementitous grout or mortar, which in turn causes the system voltage to escalate. The exact cause of this phenomenon is not known, but is generally thought to be due to acidic destruction of the cement paste surrounding the anode followed by a rapid escalation in resistance near the anode-grout interface. Failures are not believed to be due to anode drying out, as the anode-concrete interface can be observed to remain wet.

SUMMARY OF THE INVENTION

The present invention relates to a method of cathodic protection of reinforced concrete, and more particularly, to a method of improving the performance and service life of discrete anodes used in a cathodic protection system. The term "discrete anodes" as used herein refers to embedded anodes comprised of individual elements that are spaced apart from one another, as opposed to distributed anodes that essentially cover the entire concrete structure surface.

The method of the present invention comprises placing an embeddable discrete anode in, or on, the reinforced concrete member. The discrete anode is embedded in a cementitous grout or mortar to encapsulate the anode and provide contact to complete the cathodic protection circuit.

A lithium salt selected from the group consisting of lithium nitrate (LiNO3), lithium bromide (LiBr), and combinations thereof, is added to the cementitous grout or mortar surrounding the discrete anode. The lithium salt functions to enhance the performance of the cathodic protection system. The lithium salt results in a lower operating voltage and longer service life.

The lithium salt is added to the cementitous grout or mortar at a concentration of at least 0.05 gram (dry basis) per cubic centimeter of grout or mortar.

The present invention also resides in a reinforced concrete structure comprising at least one discrete anode embedded in a grout or mortar prepared according to the method of the present invention.

BRIEF DESCRIPTION OF THE DRAWINGS

Further features of the present invention will become apparent to those skilled in the art to which the present invention relates from reading the following specification with references to the accompanying drawing, in which.

DESCRIPTION OF PREFERRED EMBODIMENTS

Figure 1:
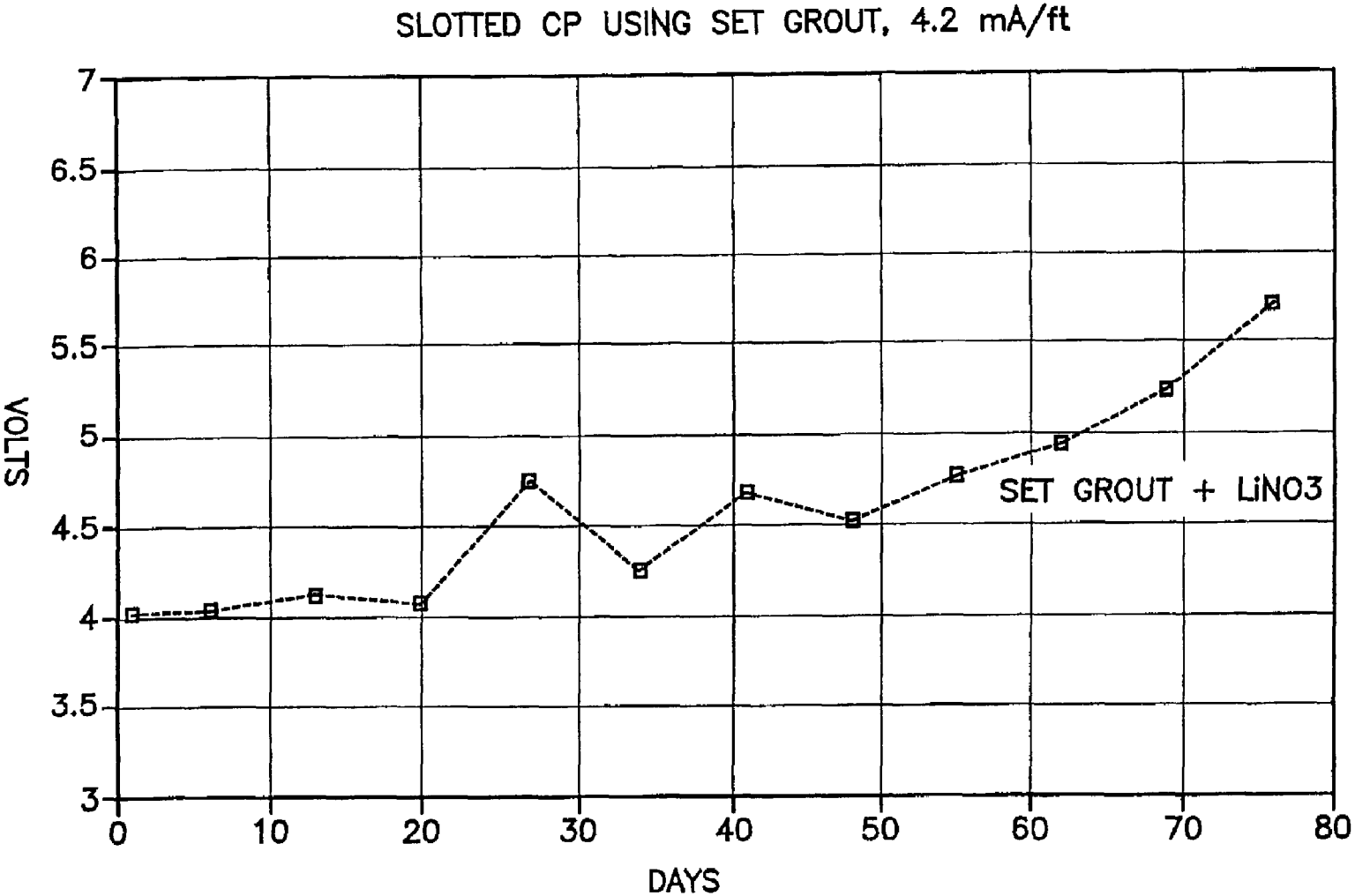
FIG. 1 is a graph showing voltage versus time for a block containing ELGARDT™ 100 (catalyzed titanium) Anode Ribbon Mesh anodes installed in slots and operated at an accelerated current density of 4.2 milliamps per foot (about four times design current rating). The ribbon anode was embedded in Set Grout™ (manufactured by Master Builders, Inc.) prepared by the addition of 17% by weight lithium nitrate solution. This resulted in a lithium nitrate concentration of about 0.1 gram (dry basis) per cubic centimeter of grout. The block was operated outdoors in northeast Ohio for 76 days.

The present invention relates broadly to all reinforced concrete structures with which cathodic protection systems are useful.

Generally, the reinforcing metal in a reinforced concrete structure is carbon steel. However, other ferrous-based metals can also be used.

The cathodic protection system of the present invention relates to discrete anodes. The term "discrete anodes" is a term of art. A discrete anode system is comprised of individual anode elements which are spaced apart from one another. The elements can be in slots in the concrete structure, holes in the concrete structure, or in patched areas in the concrete structure. The anode elements are embedded in a cementitous grout or mortar. Multiple anode elements are typically connected together to operate in a parallel electric circuit to distribute protective current to the structure.

One type of discrete anode is a pure titanium ribbon, 0.5–0.75 inch (1.25–1.9 centimeters) wide by typically 250 ft (63 meters) long, which is catalyzed by a thin surface coating of precious metal or mixed metal oxides. The titanium ribbon anode may be flat, or more commonly, it may be expanded to increase surface area and provide a better bond to the concrete. An example is ELGARD™ 100 (catalyzed titanium) Anode Ribbon Mesh. The diamond openings in the mesh are very small, for instance about a millimeter across. This type of ribbon mesh anode has typically been installed in slots 0.5 inch (1.25 centimeters) wide by 0.75 inch (1.9 centimeters) deep, cut into the top surface of a concrete deck. The slots are typically spaced about 8 to 12 inches (20.3 to 30.5-centimeters) apart. It is impractical to form slots in the surface of a concrete structure which are closer than about 8 inches (20.3 centimeters) apart. After the catalyzed titanium anode has been placed in the slot, the slot is backfilled with a cementitous grout or mortar to encapsulate the anode ribbon and provide a flat riding surface.

Another type of discrete anode is a titanium ribbon anode installed in a hole, typically 0.75–1 inch (1.9–2.5 centimeters) in diameter and 6–24 inches (15.2–61 centimeters) long, drilled into the concrete member. As with the slotted system, the holes typically are on about 8 to 12 inch (20.3 to 30.5 centimeters) centers. It is impractical to drill holes in a concrete structure which are closer together than about 8 inches (20.3 centimeters). The hole is filled with cementitous grout or mortar and the anode is inserted into the fresh grout or mortar.

Another type of discrete anode is contemplated in which a discrete anode element, such as a titanium ribbon anode, is inserted into a patch in the concrete where reinforcing steel corrosion has taken place, and where delaminated and chloride-contaminated concrete has been removed. The discrete anode thus utilized is intended to provide localized cathodic protection to reinforcing steel in the immediate area of the patch.

As with the slotted or hole-type anode system, if more than one discrete anode is used, the anodes are typically placed on 12 inch (30.5 centimeters) centers. If the anodes are closer together, for instance on centers which are four inches (10 centimeters) or less apart, then the system is likely to have characteristics more akin to a distributed anode system, and the method of the present invention is not needed.

Other configurations of a discrete anode may be contemplated by those skilled in the art, but in every case the anode consists of discrete elements separated from one another by a spacing of at least several centimeters (ten or more), as distinguished from anodes which essentially cover the entire surface of the structure, and each element is configured within a relatively small, confined area, often substantially or completely surrounded by the reinforced concrete structure.

The composition of these anodes may include catalyzed titanium, titanium suboxide, or sacrificial metals such as zinc, aluminum, or alloys thereof.

Whatever its composition, the discrete anode is embedded in a cementitous grout or mortar to encapsulate the anode and is provided with electrical contact to complete the cathodic protection circuit. A flowable grout is typically used for horizontal applications, whereas a thick trowelable mortar is typically used for vertical and overhead applications. The grout or mortar is typically supplied as a powder, and is mixed on site with water or solution supplied by the manufacturer. The grout or mortar must have a low volumetric resistivity to permit operation of the cathodic protection system at a reasonable voltage. Several such grouts and mortars are commercially available and are well known to those skilled in the art.

When the discrete anodes of the present invention are inert, they are typically connected together to operate in a parallel electrical circuit, the anodes being connected to the positive pole of a power supply, and the reinforcing steel of the structure connected to the negative pole of the power supply.

When the discrete anodes are sacrificial, they may be locally or remotely connected directly to the surrounding reinforcing steel. In this case, the protective current flows spontaneously since the electrochemical reactions that cause current flow are thermodynamically favored, and no power supply is needed.

In the present invention, a lithium salt selected from the group consisting of lithium nitrate ($LiNO_3$), lithium bromide (LiBr), and combinations thereof, is added to the encapsulating grout or mortar. The lithium salt may be incorporated into the dry mix prior to hydration, or may be added to the water or solution that is added to the mix prior to placement. The latter is especially advantageous since these lithium salts are both readily available and economical when supplied as aqueous solutions. Lithium nitrate would typically be the preferred salt for use with inert anodes and lithium bromide would typically be the preferred salt for use with sacrificial anodes, although both lithium salts can be advantageous for either type of discrete anode.

The amount of lithium salt required varies depending on the type of anode, the type of grout, the current density, and the geometry of the structure. Broadly, the amount of lithium salt required is that needed to facilitate the transport of anode reaction products and to maintain a relatively low system operating voltage. Preferably, the amount of lithium salt required is about 0.05 to 1.0 gram (dry basis) per cubic centimeter of hardened grout or mortar. If too little lithium salt is used, the desired result will not be achieved. If too much lithium salt is used, this will result in an additional expense for no benefit. A solution of about 5.2 molar lithium nitrate (which is very concentrated), when added to a grout or mortar mix in normal proportions gives a salt concentration in the grout or mortar of about 0.1 gram per cubic centimeter. A solution of about 10.9 molar lithium bromide (which is very concentrated), when added to a grout or mortar mix in normal proportions gives a salt concentration in the grout or mortar of about 0.25 gram per cubic centimeter.

When the cathodic protection system is connected to the reinforcing steel of the concrete structure, lithium ions migrate to the reinforcing steel. However, in the present invention, the amount of lithium ions in the grout or mortar is sufficient that depletion of lithium ions from the vicinity of the discrete anodes is negligible.

The use of lithium salts as taught by the present invention has been found to mitigate the harmful effects of anode reaction products. Bleeding of acidic liquid to the concrete surface and subsequent deterioration of surrounding grout and concrete has been found to be delayed. The rise in system voltage associated with such deterioration has been found to be diminished. The lithium salts of the present invention are thought to be unique in this regard. The same benefit is not realized by the addition of sodium salts, for example. The reasons for the effectiveness of lithium salts to enhance the performance of discrete anodes are not fully understood.

Although not to be held to any theory, it is thought that a high concentration of lithium salts near the anode-grout or mortar interface produces a region of high conductivity and high diffusion rate, facilitating the migration of anode reaction products away from the anode-grout or mortar interface. If anode reaction products are not allowed to concentrate, they will be less likely to destroy the cement paste by dissolution of calcium hydroxide, followed by channeling of acidic liquid along the anode and through cracks. The property of lithium salts for promoting the retention of moisture may possibly be a factor, but is not thought to be critical since these areas are observed to remain wet in any case.

It may be advantageous to also add certain agents to improve the effectiveness of the lithium salts. For example, it may be advantageous to include a wetting agent or surface active agent in the lithium salt solution. The wetting agent or surface active agent is conveniently added to the water or liquid prior to mixing with the dry grout or mortar mix. The wetting agent or surface active agent assists in the wetting and migration of anode reaction products away from the anode-concrete interface. Soaps, alcohol, fatty acids and detergents are effective wetting agents.

A large number of surface active agents are commercially available. The surface active agent should be one which has good wettability characteristics and preferably is one which is soluble in water or other polar solvent. A preferred surface active agent is a cationic amine or ammonium compound.

Surface active agents generally have a hydrophobic portion, usually including a long hydrocarbon chain, and a hydrophilic portion which renders the compound soluble in water or other polar solvent. In a cationic surface active agent, the hydrophilic portion of the molecule carries a positive charge which is responsible for the surface active properties. Examples of cationic surface active agents are amine acetates, alkyl trimethyl ammonium chlorides, dialkyl dimethyl ammonium chlorides, alkyl pyridinium chlorides and lauryl dimethyl benzyl ammonium chloride.

A cationic surface active agent that has been found to be particularly useful in the present invention includes the following combination of ingredients;

| | |
|---|---|
| n-alkyl (50% $C_{14}$, 40% $C_{12}$, 10% $C_{16}$) dimethyl benzyl ammonium chloride | 80 ppm |
| Octyl decyl dimethyl ammonium chloride | 12.5 ppm |
| Dioctyl dimethyl ammonium chloride | 6.25 ppm |
| Didecyl dimethyl ammonium chloride | 6.25 ppm |

This cationic surface active agent is marketed by Lysol® as their deodorizing cleanser. It is disclosed in U.S. Pat. Nos. 5,454,984 and 5,522,942. Another surface active agent found to be effective is "SPRAY AND WASH" marketed by Dow Brands, Indianapolis, Ind.

Preferably, the surface active agent is used in the amount of at least about 50 ppm active agent in the water or liquid added to the dry grout or mortar to hydrate the grout or mortar, more preferably about 100 to about 1,000 ppm. About 0.2 to about 2% by volume Lysol® deodorizing cleanser, more preferably about 1%, was found to work well.

It may also be advantageous to add an alkali metal hydroxide to the grout or mortar. The excess alkali so added will neutralize acid produced at the anode, and forestall the deleterious effects of the acid on the cementitous grout or mortar.

EXAMPLE I

A concrete block was constructed with dimensions of 12×12×4 inches (30.5×30.5×10.2 centimeters). The block contained four 9 inch (22.9 centimeters) long No. 6 (1.9 centimeters diameter) reinforcing bars spaced on 3 inch (7.6 centimeters) centers. There was a 1 inch (2.54 centimeters) depth of cover measured from the working surface of the block. The reinforcing bars were electrically connected forming a grid. Chloride was admixed into the concrete to achieve a total (acid soluble) chloride concentration of 20 pounds per cubic yard (about 0.52% chloride by weight of concrete). The mix proportions of the concrete were as follows:

| | |
|---|---|
| Type 1 Portland Cement (Essroc) | 715 lb/yd$^3$ (425 kg/m$^3$) |
| Frank Road Sand Fine Aggregate | 1010 lb/yd$^3$ (600 kg/m$^3$) |
| No. 57 American Aggregates Limestone | 1830 lb/yd$^3$ (1090 kg/m$^3$) |
| Water | 285 lb/yd$^3$ (170 kg/m$^3$) |
| Air | About 6% |

Following a 24-hour mold curing period, the block was placed in a controlled temperature/humidity room maintained at 100% relative humidity and 74° F. (23° C.) where it remained for 28 days.

A 0.5 inch wide×0.75 inch deep (1.25 centimeters wide×1.9 centimeters deep) slot was cut on the top of the block, positioned parallel to, and midway between the reinforcing bars. An ELGARD™ 100 Anode Ribbon Mesh (discrete catalyzed titanium anode) was then placed in the slot.

The slot of the block was filled with Set Grout™ by Master Builders, Inc. modified by mixing the dry grout with lithium nitrate solution to the amount of 17% by weight of dry mix. The lithium nitrate solution contained about 360 grams per liter of lithium nitrate and 1% by volume Lysol® deodorizing cleanser. The grout thus prepared was placed in the slot to completely encapsulate the anode ribbon mesh. After curing, the hardened grout contained about 0.1 gram of lithium nitrate (dry basis) per cubic centimeter of grout. The block was then wrapped in plastic for two weeks for wet curing of the grout.

After curing, the anode and reinforcing steel were connected to a power supply and energized at a constant current of 4.2 milliamps. This current is 4.2 times the design current of the ELGARD™ 100 (catalyzed titanium) Anode Ribbon Mesh. This is therefore an accelerated test designed to hasten deterioration due to anode reaction product. The block was maintained at this current density outdoors in northeast Ohio from July to September 1999. Voltage between the anode and reinforcing steel was recorded weekly, and is shown as a function of time on FIG. 1. The rise and fall of the voltage shown on FIG. 1 is due in part to the natural outdoor variations in temperature and moisture content.

After 76 days on line, the block prepared with Set Grout™ doped with the lithium nitrate solution looked unchanged, and showed no evidence of bleeding or wetness. This treated block showed a slight increase in voltage, as shown by FIG. 1, but not nearly as great as would be expected for an untreated block.

Those skilled in the art will recognize that a block prepared in the manner described above, but without the addition of lithium nitrate, operated at this current density for 76 days, would be expected to have a large amount of acidic liquid bleeding through the upper surface of the grout. The grout would likely appear dark and moist, and the acidic liquid would cause softening and discoloration of the grout. The operating voltage of a block without the addition of lithium nitrate would be likely to be in excess of about seven (7) volts.

This example confirmed that the addition of lithium nitrate greatly enhances the performance of discrete catalyzed titanium anodes embedded in a cementitous grout.

EXAMPLE II

A steel reinforced 12×12×4-inch (30.5×30.5×10.2-centimeter) concrete block was constructed using concrete with the following mix proportions:

| | |
|---|---|
| Type 1 Portland Cement (Essroc) | 715 lb/yd$^3$ |
| Frank Road Sand (SSD) | 1010 lb/yd$^3$ |
| No. 57 American Aggregates Limestone (SSD) | 1830 lb/yd$^3$ |
| Water | 285 lb/yd$^3$ |
| Air | 6% ± 2% |

The block contained four #6 reinforcing bars 0.75-inch (1.9-centimeter) diameter by 9 inches (22.9 centimeters) long. The reinforcing bars were spaced 3 inches (7.6 centimeters) apart and parallel to each other with 2 inches (5.1 centimeters) of cover between the bars and the top surface of the block. The block was constructed in 1996, and was maintained outdoors in Ohio until this experiment.

For this experiment, four 2-inch (5.1 centimeter) diameter by 2-inch (5.1 centimeter) deep holes were cut in the block, each hole being 3-inch (7.6 centimeter) centerline distance from a corner of the block. A No. 18 -gage stranded copper wire connection was attached to each of four 1.6-inch (4.1 centimeter) long pieces of Standard Platline™ Zinc Ribbon Anodes using ring connectors and self-tapping screws. Standard Platline Ribbon is a pure zinc anode produced by Platt Brothers & Company, Waterbury, Conn. The connections were then coated with a two-part non-conductive epoxy, and the anodes were positioned In the bottom of the four cut holes.

The holes were then filled with the following mixes based on Eucopatch, a one-part cementitous repair material produced by the Euclid Chemical Company, Cleveland, Ohio. The pH of each mix (taken wet) is indicated as follows:

| Zinc Wt. | Mix Material | pH |
|---|---|---|
| 1. 35.18 gm | 648 gm Eucopatch + 100 ml water | 12.5* |
| 2. 34.19 gm | 648 gm Eucopatch + 100 ml water + 8.4 gm LiOH | 14.5* |
| 3. 35.20 gm | 648 gm Eucopatch + 100 ml of 950 gm/l LiBr solution | 7.4* |
| 4. 34.95 gm | 648 gm Eucopatch + 100 ml of 360 gm/l $LiNO_3$ solution | 10.3* |

*estimated pH
**measured pH

After allowing two days for the Eucopatch to cure, each anode was energized by an electrical connection to the reinforcing bars. Connection was made through a 10-ohm resistor to facilitate measurement of galvanic current flow. The flow of protective current to the reinforcing steel was recorded, and is shown on FIG. 2.

Figure 2:
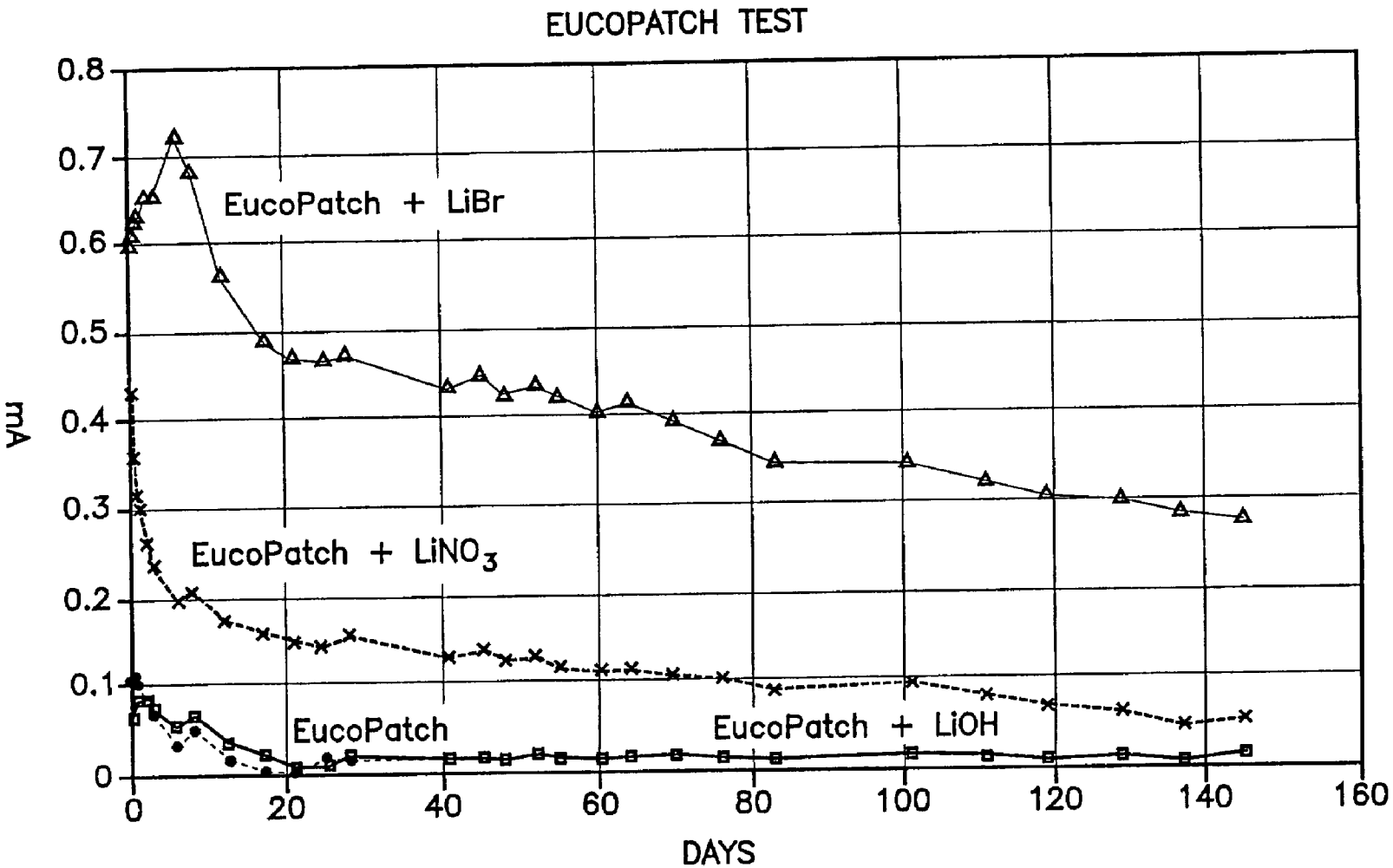
FIG. 2 is a graph showing current against time comparing the performance of discrete anode cathodic protection systems of the present invention with discrete anode cathodic protection systems of the prior art. The anode cathodic protection systems are positioned in holes cut into the concrete structure.

As shown on FIG. 2, the protective cathodic current flow provided by the anode surrounded by both the Eucopatch and the Eucopatch +LiOH was very low, generally about 0.01 mA after 20 days. The protective current provided by the anode surrounded by Eucopatch +$LiNO_3$ solution was much higher, about 0.15 MA, after 20 days, and the protective current provided by the Eucopatch +LiBr solution was higher still, about 0.45 mA, after 20 days. It will be recognized by those skilled in the art that installation of all four experiments into the same block will reduce the protective current provided by each anode, but will also make the comparison between anodes especially relevant. The higher cathodic currents provided by the discrete zinc anodes surrounded by mixes containing LiBr and $LiNO_3$ will result in greater cathodic polarization of the reinforcing steel, and therefore greater protection against corrosion than that provided by the zinc anodes surrounded by mixes containing only water and LiOH. In this experiment, both LiBr and $LiNO_3$ were clearly much more effective for activating the zinc anode than the LiOH.

EXAMPLE III

Figure 3:
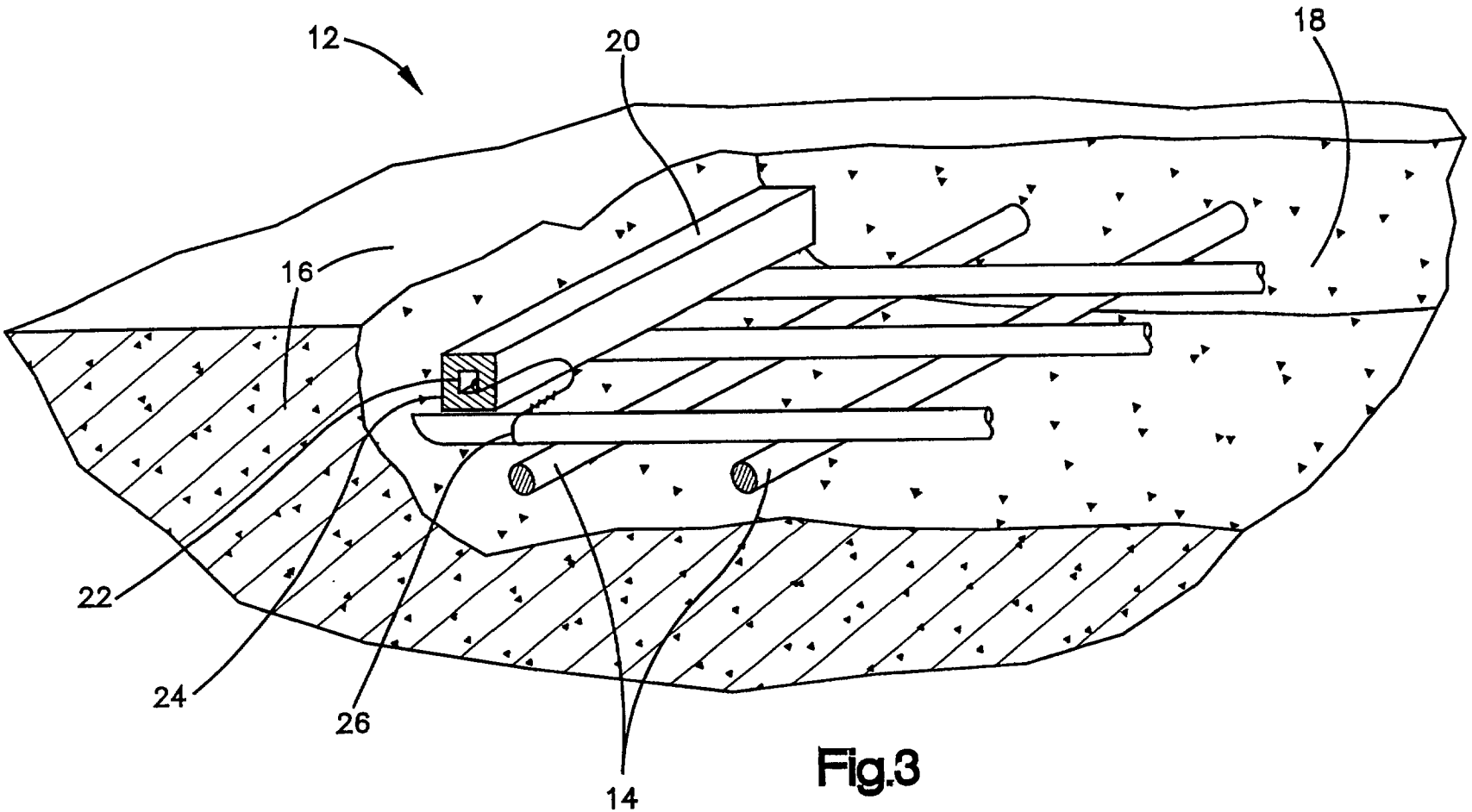
FIG. 3 is an illustration of a discrete anode cathodic protection assembly in accordance with a further embodiment of the present invention.

This Example illustrates the embodiment of FIG. 3. FIG. 3 shows a steel reinforced concrete structure 12, the reinforcement 14 of which is subject to corrosion due to carbonation or ingress of chloride ions from deicing salt or set accelerators. The original concrete 16 of the structure may still be structurally sound, but may be chloride contaminated. A pothole or excavation 18 is representative of damage caused by corrosion of the reinforcement 14, wherein corrosion products have resulted in expansion of the reinforcement 14 and subsequent cracking and delamination of the concrete 16. The concrete 16 is thus in need of patching.

In the present invention, an assembly 20 is placed in the excavation 18 for the express purpose of preventing corrosion and subsequent delamination of the original concrete 16 outside of the excavation 18. An end of the assembly 20 is shown cut away in cross section to better illustrate the features of the present invention. The assembly 20 consists of a sacrificial anode 22 surrounded by an activating grout or mortar 24 to which either lithium bromide, lithium nitrate, or a combination thereof has been added. Wire leads 26 connect the sacrificial anode 22 and the reinforcement 14. After positioning the assembly 20 in the excavation 18, the excavation 18 is then patched with cementitous patch material (not shown) to restore the original concrete surface. Once the patch material is in place, protective galvanic current will flow from the sacrificial anode 22 to the reinforcing steel to mitigate further corrosion damage of the structure.

The anodes 22, activating grout or mortar 24, and wire leads 26 are assembled as precast units for simplified installation at a construction site. The precast units (assemblies 20) are made by positioning an anode 22 within a mold (not shown) so that the leads 26 extend to the outside of the mold, and then pouring the activating grout or mortar 24 into the mold around the anode 22. The assembly 20 comprising anode 22 and grout or mortar 24 may have a variety of shapes and sizes. The assembly 20 may be long and thin as shown in FIG. 3, or short and round or square, or have any number of other configurations. The assembly must be sufficiently small in at least one direction to permit placement in excavations as shallow as about 2 inches (5.1 centimeters) covered with at least several millimeters of patch material.

As shown in FIG. 3, the discrete anodes are those that are not distributed essentially over the entire surface of the concrete structure being protected, but are rather positioned only occasionally for more localized protection against corrosion. Multiple discrete anodes typically are positioned in a patch area. Separation between discrete anodes is typically at least about 4 inches (10 centimeters). The precast units are typically placed at the edge of an excavation or patch at proper centerline spacings, and wired directly to the adjacent exposed reinforcing steel.

Examples of sacrificial anode materials 22 are zinc, aluminum, magnesium or alloys thereof. Such anode materials exhibit an inherently electronegative potential, and as such, sacrifice themselves by corroding to provide current for cathodic protection of steel in concrete.

In the embodiment of FIG. 3, the lithium salt is mixed into the grout or mortar 24 together with the water used for hydration of the cementitous material, prior to encapsulating the anode with the grout or mortar. Alternatively, the dry lithium salt may be mixed into the dry grout or mortar prior to the addition of water. As previously indicated, the lithium salt is added in the amount of at last 0.05 gram (dry basis) per cubic centimeter of hardened grout or mortar. For optimum results in this embodiment, the lithium salt is added in the amount of 0.10 to 0.50 gram (dry basis) per cubic centimeter of hardened grout or mortar. When used in these quantities, the pH of the grout or mortar ranges from about pH 7 to pH 10.

The grout or mortar 24 used to encapsulate the sacrificial anode 22 may be comprised simply of sand, cement and water, or it may be modified by one or more of several additives typically used to improve the properties of cementitous repair products. Such additives include water reducers, fly ash, silica fume, latex and other polymers. In any case, the grout or mortar encapsulating the sacrificial anode should not have volumetric resistivity greater than 20,000 ohm-centimeters. It should also have sufficient strength to withstand abuse and handling typical of that encountered in construction projects in the field.

The thickness of the grout or mortar 24 surrounding the sacrificial anode 22 is typically at least 0.30 centimeter, and preferably about 0.50 to 2.0 centimeter. If the thickness of the grout or mortar 24 is too thin, It will not effectively maintain the sacrificial anode 22 in an active state long-term, whereas if the thickness of the grout or mortar 24 is too thick, it will incur increased cost for no benefit.

The sacrificial anode 22 is energized by connecting wire lead 26 between the anode 22 and the steel reinforcement 14. The wire lead 26 may be copper, steel, or other metals, and may be cast, soldered, welded, mechanically or otherwise connected to both anode and steel to provide a secure electrical contact with a low electrical resistance. The wire may be insulated or not insulated.

A purpose of the assemblies 20 of this embodiment of the present invention is to provide sufficient localized protective current to polarize the steel outside the excavation and prevent the so-called "anode ring effect", the tendency of steel reinforcement outside the excavation 18 to become anodic and undergo more rapid deterioration due to increased corrosion activity. Thus, the assemblies 20 are preferably located at the perimeter of the excavation 18. For best effectiveness the anode-mortar assemblies 20 are installed from about 4–12 inches (10.2–30.5 centimeters) apart. If installed more than about 20 inches (50.8 centimeters) apart, the anodes 22 may not provide adequate protection to steel located midway between the anodes. Alternatively, the anode-mortar assemblies 20 may be installed in a concrete structure spaced at regular intervals to provide general protection for embedded steel.

The following is further illustration of this embodiment of the present invention. A steel reinforced concrete block was constructed and maintained as described in Example 1. For this experiment, two 4×4-inch (10.2×10.2-centimeter) square by 2-inch (5.1-centimeter) deep holes were cut into the top surface of the concrete block.

A copper wire was attached to a 1.6-inch (4.1-centimeter) long piece of Standard Platline™ Zinc Ribbon Anode as described in Example 1. The zinc anode was then cast into a 2½-inch (6.4 centimeter) diameter by 1-inch (2.5 centimeter) deep "puck" using Sika 223 mixed with 950 gm/l LiBr solution. Sika 223 is a one-component cementitous repair material for vertical and overhead patching of concrete produced by Sika Corporation of Lyndhurst, N.J. The pH of the wet cementitous mix was measured as about 7.5.

The puck thus constructed was then placed into one of the square holes in the block, and the hole was patched over using Sika 223 patch repair material. A commercial Galvashield-XP puck was placed into the other square hole, and this hole was also patched over using Sika 223. The Galvashield-XP puck contained no LiBr or $LiNO_3$ salt. It is reported to contain LiOH. Connection was made from each anode to the reinforcing steel through a 10-ohm resistor to facilitate measurement of galvanic current flow. The flow of protective current to the reinforcing steel was recorded, and is shown in FIG. 4.

Figure 4:
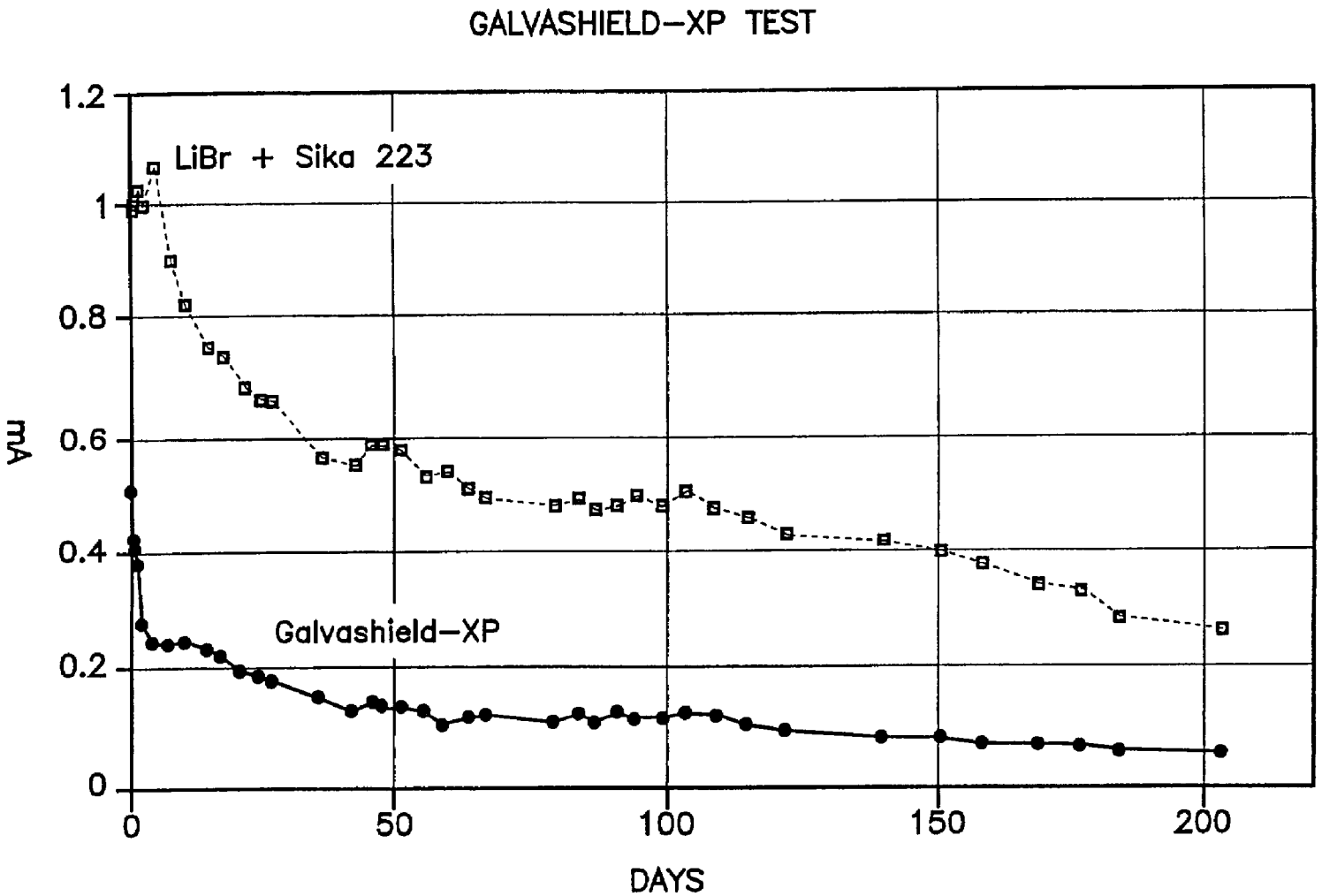
FIG. 4 is a graph showing current against time comparing the performance of a discrete anode cathodic protection assembly of the type of FIG. 3 with a discrete anode cathodic protection assembly of the prior art.

As can be seen on FIG. 4, the flow of protective current provided by the zinc anode in the mix containing LiBr was about five (5) times that provided by the commercial Galvashield-XP puck. It will be recognized that the higher cathodic current provided by the discrete zinc anode surrounded by mix containing LiBr will result in greater cathodic polarization of the reinforcing steel, and therefore greater protection against corrosion than that provided by the Galvashield-XP puck. In this experiment, LiBr was clearly more effective than the lithium hydroxide activating agent used in the Galvashield-XP.

From the above description of the invention, those skilled in the art will perceive improvements, changes and modifications. Such improvements, changes and modifications within the skill of the art are intended to be covered by the appended claims.

Having described the invention, the following is claimed:

1. A method of cathodic protection of reinforced concrete comprising the steps of:

(1) applying at least one discrete anode to said reinforced concrete;

(2) embedding said discrete anode in a cementitous grout or mortar;

(3) said cementitous grout or mortar having distributed therein a lithium salt selected from the group consisting of lithium nitrate, lithium bromide, and combinations thereof, in the amount of at least about 0.05 gram (dry basis) per cubic centimeter of grout or mortar; and (4) causing or allowing current to flow between said anode and reinforcing steel such that the steel is cathodically protected.

2. The method of claim 1 comprising multiple discrete anodes.

3. The method of claim 2 wherein said discrete anodes are contained within slots in a surface of the concrete and the slots are filled with said cementitous grout or mortar.

4. The method of claim 2 wherein said discrete anodes are contained within holes in said concrete and said holes are filled with said cementitous grout or mortar.

5. The method of claim 2 wherein said anodes are zinc, aluminum, or titanium, or alloys thereof.

6. The method of claim 1 wherein the concentration of lithium salt in the grout or mortar is In the range of about 0.05 to about 1.0 gram per cubic centimeter.

7. The method of claim 1 wherein the concentration of lithium salt is effective to produce a region of high conductivity and diffusion rate near the anode concrete interface facilitating the migration of anode reaction products away from the interface.

8. The method of claim 1 wherein said cementitous grout or mortar also comprises a surface active agent distributed therein.

9. The method of claim 8 wherein said surface active agent is a cationic amine or ammonium compound.

10. The method of claim 9 wherein said lithium salt and surface active agent are added to a carrying medium to form a dispersion or suspension and said dispersion or suspension is added to a mix of said grout or mortar prior to placement of the grout or mortar about said discrete anode.

11. A cathodic protection system for the protection of reinforced concrete prepared according to the steps comprising:

(1) applying at least one discrete anode to said reinforced concrete;

(2) embedding said discrete anode in a cementitous grout or mortar;

(3) said cementitous grout or mortar having distributed therein a lithium salt selected from the group consisting of lithium nitrate, lithium bromide, and combinations thereof, in the amount of at least about 0.05 gram (dry basis) per cubic centimeter of grout or mortar; and (4) causing or allowing current to flow between said anode and reinforcing steel such that the steel is cathodically protected.

12. A cathodic protection system for a reinforced concrete structure comprising:

(1) at least one discrete anode affixed to said reinforced concrete structure;

(2) a cementitous grout or mortar encapsulating said discrete anode;

(3) said grout or mortar having distributed therein a lithium salt selected from the group consisting of lithium nitrate, lithium bromide, and combinations thereof in the amount of at least about 0.05 gram (dry basis) per cubic centimeter of grout or mortar.

13. The system of claim 12 comprising multiple discrete anodes.

14. The system of claim 13 wherein said discrete anodes are contained within slots in a surface of the concrete and the slots are filled with said cementitous grout or mortar.

15. The system of claim 13 wherein said discrete anodes are contained within holes in said concrete and said holes are filled with said cementitous grout or mortar.

16. The system of claim 13 wherein said anodes are zinc, aluminum, or titanium, or alloys thereof.

17. The system of claim 12 wherein the concentration of lithium salt in the grout or mortar is in the range of about 0.05 to about 1.0 grams per cubic centimeter.

18. The system of claim 12 wherein the concentration of lithium salt is effective to produce a region of high conductivity and diffusion rate near the anode concrete interface facilitating the migration of anode reaction products away from the interface.

19. The system of claim 12 wherein said cementitous grout or mortar also comprises a surface active agent distributed therein.

20. The system of claim 19 wherein said surface active agent is a cationic amine or ammonium compound.

21. A cathodic protection assembly for cathodic protection of reinforced concrete having reinforcement comprising:

(a) at least one discrete anode;

(b) a cementitous grout or mortar encapsulating said discrete anode;

(c) connections penetrating said grout or mortar for connecting said anode electrically to said reinforcement; and (d) a lithium salt selected from the group consisting of lithium nitrate, lithium bromide, and combinations thereof dispersed in said grout or mortar in the amount of at least about 0.05 gram (dry basis) per cubic centimeter of grout or mortar.

22. The assembly of claim 21 wherein said anode is zinc, aluminum, titanium or alloys thereof.

23. The assembly of claim 22 wherein said anode is sacrificial.

24. The assembly of claim 21 wherein the concentration of lithium salt in the grout or mortar is in the range of about 0.05 to about 1.0 gram per cubic centimeter of grout or mortar.

25. The assembly of claim 24 further comprising a surface active agent dispersed in the grout or mortar.

26. The assembly of claim 25 wherein said surface active agent is a cationic amine or ammonium compound.

27. The assembly of claim 21 having a shape and size permitting distribution of more than one encapsulated discrete anode in a small patch area of reinforced concrete.

28. A cathodic protection system comprising at least one cathodic protection assembly of claim 21.

29. A cathodic protection system comprising multiple cathodic protection assemblies of claim 21 in a patch area of said reinforced concrete.

30. The assembly of claim 21 wherein said anode is zinc or an alloy thereof and said lithium salt is dispersed in the mortar or grout in the amount of at least about 0.05 gram per cubic centimeter of grout or mortar, said discrete anode having a shape and size permitting distribution of more than one encapsulated discrete anode in a small patch area of reinforced concrete.

31. The assembly of claim 30 wherein the grout or mortar is approximately equally distributed around the discrete anode.

* * * * *